US007238116B1

(12) United States Patent
Sulzener

(10) Patent No.: US 7,238,116 B1
(45) Date of Patent: Jul. 3, 2007

(54) GOLF SWING TRAINING APPARATUS AND METHOD FOR USING THE SAME

(76) Inventor: Randy W. Sulzener, 2573 Sharon Copley Rd., Medina, OH (US) 44256

( * ) Notice: Subject to any disclaimer, the term of this patent is extended or adjusted under 35 U.S.C. 154(b) by 166 days.

(21) Appl. No.: 11/153,169

(22) Filed: Jun. 16, 2005

(51) Int. Cl.
*A63B 69/36* (2006.01)

(52) U.S. Cl. ..... 473/259; 473/258

(58) Field of Classification Search ..... 473/216, 473/229, 257–260
See application file for complete search history.

(56) References Cited

U.S. PATENT DOCUMENTS

| | | | | |
|---|---|---|---|---|
| 1,567,530 | A * | 12/1925 | MacNaughton et al. | 473/229 |
| 2,737,432 | A | 3/1956 | Jenks | |
| 2,868,543 | A * | 1/1959 | Zega | 473/259 |
| 3,341,208 | A * | 9/1967 | Marcella | 473/259 |
| 3,583,707 | A * | 6/1971 | Fujimoto | 473/259 |
| 3,711,103 | A * | 1/1973 | Seltzer | 473/229 |
| 4,566,696 | A | 1/1986 | Horgen | |
| 4,758,000 | A | 7/1988 | Cox | |
| 4,852,881 | A * | 8/1989 | Bellagamba et al. | 473/216 |
| 4,895,372 | A | 1/1990 | Muller | |
| 4,949,974 | A * | 8/1990 | Bellagamba | 473/216 |
| 5,050,885 | A | 9/1991 | Ballard et al. | |
| 5,116,058 | A * | 5/1992 | Theriault | 473/268 |
| 5,429,367 | A * | 7/1995 | Amos | 473/259 |
| 5,441,275 | A * | 8/1995 | Yoshishita | 473/259 |
| 5,467,993 | A * | 11/1995 | Higginson | 473/229 |
| 5,595,545 | A * | 1/1997 | O'Brien | 473/259 |
| 5,688,212 | A | 11/1997 | Walker | |
| 5,816,932 | A * | 10/1998 | Alexander | 473/259 |
| 5,984,798 | A * | 11/1999 | Gilmour | 473/221 |
| 5,997,410 | A | 12/1999 | Nothdurff | |
| 6,273,826 | B1 * | 8/2001 | Bauer | 473/219 |
| 6,364,786 | B1 * | 4/2002 | Khano | 473/257 |
| 6,578,008 | B1 | 6/2003 | Chacker | |
| 6,612,845 | B1 | 9/2003 | Macri et al. | |
| 6,656,055 | B1 | 12/2003 | Marro | |
| 6,669,575 | B1 | 12/2003 | Marlette | |

* cited by examiner

*Primary Examiner*—Raleigh W. Chiu
(74) *Attorney, Agent, or Firm*—John D. Gugliotta

(57) ABSTRACT

A golf swing training apparatus is provided. The golf swing training apparatus is adapted to be folded in a collapsed state to facilitate quick and easy transportation and storage. The golf swing training apparatus has a main frame assembly defining a pair of A-frames joined by a pair of cross members. Each A-frame includes a spar being telescopically adjustable. A plurality of adjustable feet are provided to level the apparatus when placed atop uneven surfaces. A guide ring is hingedly attached to the pair of A-frames and is adapted to be angularly and vertically adjusted. The guide ring is further provided with multi-colored bands and indicia to serve as visual references when practicing particular golf strokes.

16 Claims, 18 Drawing Sheets

Q

GOLF SWING TRAINING APPARATUS AND METHOD FOR USING THE SAME

RELATED APPLICATIONS

The present invention was first described in Disclosure Document Number 565,969, filed on Dec. 2, 2004 under 35 U.S.C. §122, 37 C.F.R. §1.14, and MPEP §1706. There are no previously filed, nor currently any co-pending applications, anywhere in the world.

BACKGROUND OF THE INVENTION

1. Field of the Invention

The present invention relates generally to golf training devices and, more particularly, to a golf swing training apparatus.

2. Description of the Related Art

Executing the ideal golf swing comprises many important elements such as maintaining a stationary head with eyes fixed upon the golf ball, proper alignment of the upper and lower torso, a shifting of weight to the right foot in the backswing, proper curling of arms, wrists, shoulders, and hips, proper coiling of the back, a shifting of weight to the left foot at the start of the downswing, and clearance of the hips prior to impact.

In view of the overwhelming number of physical and mental elements compressed into the brief time required to execute a golf swing, the average person finds it extremely difficult to retain and execute the requisite sequence of information while performing a golf stroke.

As a result, a long felt solution to the aforementioned problem was needed to alleviate the shortcomings promoted thereby. Particularly, the elements of the golf swing needed to be broken down into manageable parts and a device was needed to physically guide the golfer through the ideal swing.

Hence, there is a need for a golf training device which through practice enables the user to execute the ideal golf swing.

A search of the prior art did not disclose any patents that read directly on the claims of the instant invention; however, the following references were considered related.

The following patents disclose various golf swing training devices and methods for use thereof:

U.S. Pat. No. 4,895,372, issued in the name of Muller;

U.S. Pat. No. 6,656,055, issued in the name of Marro;

U.S. Pat. No. 5,997,410, issued in the name of Nothdurft;

U.S. Pat. No. 6,612,845 B1, issued in the name of Macri et al.;

U.S. Pat. No. 6,669,575 B1, issued in the name of Marlette;

U.S. Pat. No. 4,566,696, issued in the name of Horgen;

U.S. Pat. No. 5,688,212, issued in the name of Walker;

U.S. Pat. No. 4,758,000, issued in the name of Cox; and

U.S. Pat. No. 5,050,885, issued in the name of Ballard et al.

U.S. Pat. No. 6,595,266 B2, issued in the name of Orii discloses a method of manufacturing metallic slurry for casting.

Website publication, "Explanar Golf Training System" at www.explanar.com.

Accordingly, there exists a need for a golf swing training apparatus which allows a user to execute the ideal golf swing in a manner which is quick, easy, and efficient.

SUMMARY OF THE INVENTION

It is therefore an object of the present invention to provide a golf swing training apparatus adapted to allow user to execute an ideal golf swing.

It is another object of the present invention to provide a golf swing training apparatus adapted to collapse without disassembly to facilitate quick and easy storage and transportation.

It is another object of the present invention to provide a guide ring which provides user with the proper swing path for executing an ideal golf swing.

It is a feature of the present invention to provide a guide ring which is both angularly and height adjustable to accommodate the particular user.

It is another object of the present invention to provide guide ring being hingedly attached to a frame assembly.

It is another object of the present invention to provide a frame assembly having a plurality of adjustable feet to level the device when placed atop uneven surfaces.

It is another object of the present invention to provide guide ring liners adapted to be snap fastened over an external circumferential surface of the guide ring in order to prevent damage to the club head of a standard golf club during use of the present invention.

It is still another object of the present invention to provide a putting guide rail.

Briefly described according to one embodiment of the present invention, a golf swing training apparatus is provided. The golf swing training apparatus is adapted to be folded in a collapsed state to facilitate quick and easy transportation and storage. The golf swing training apparatus comprises a main frame assembly defining a pair of A-frames joined by a pair of cross members. Each A-frame includes a spar being telescopically adjustable.

The golf swing training apparatus further comprises a plurality of adjustable feet adapted to level the apparatus when placed atop uneven surfaces.

The golf swing training apparatus is further comprised of guide ring defined of a collapsible, annular member constructed from a rigid material. The annular member is formed of two semi-spherical segments being hingedly attached. The guide ring is attached to a frontal cross member via bracket which rotatably supports a guide ring support column. The guide ring support column functions to rotatably support and allow for telescopic adjustment of a guide ring. The guide ring is further hingedly attached to each spar via lower brackets formed integral to guide ring.

The first semi-spherical segment and second semi-spherical segment forming guide ring are compressed together and maintained in a compressed position, thereby forming the annular member, via a guide ring compression apparatus.

In order to prevent damage to the club head of a standard golf club during use of the present invention, a plurality of guide ring liners are provided. The guide ring liners are defined of elongated, arcuate-shaped strips fabricated of a lightweight, rigid material adapted to be snap fastened over an external circumferentail surface of guide ring.

A putting guide rail is provided which is formed of a rigid, tubular material having an elongated straight portion and opposite ends thereof bent at right angles to the elongated straight portion.

The use of the present invention allows a user to execute the ideal golf swing in a manner which is quick, easy, and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
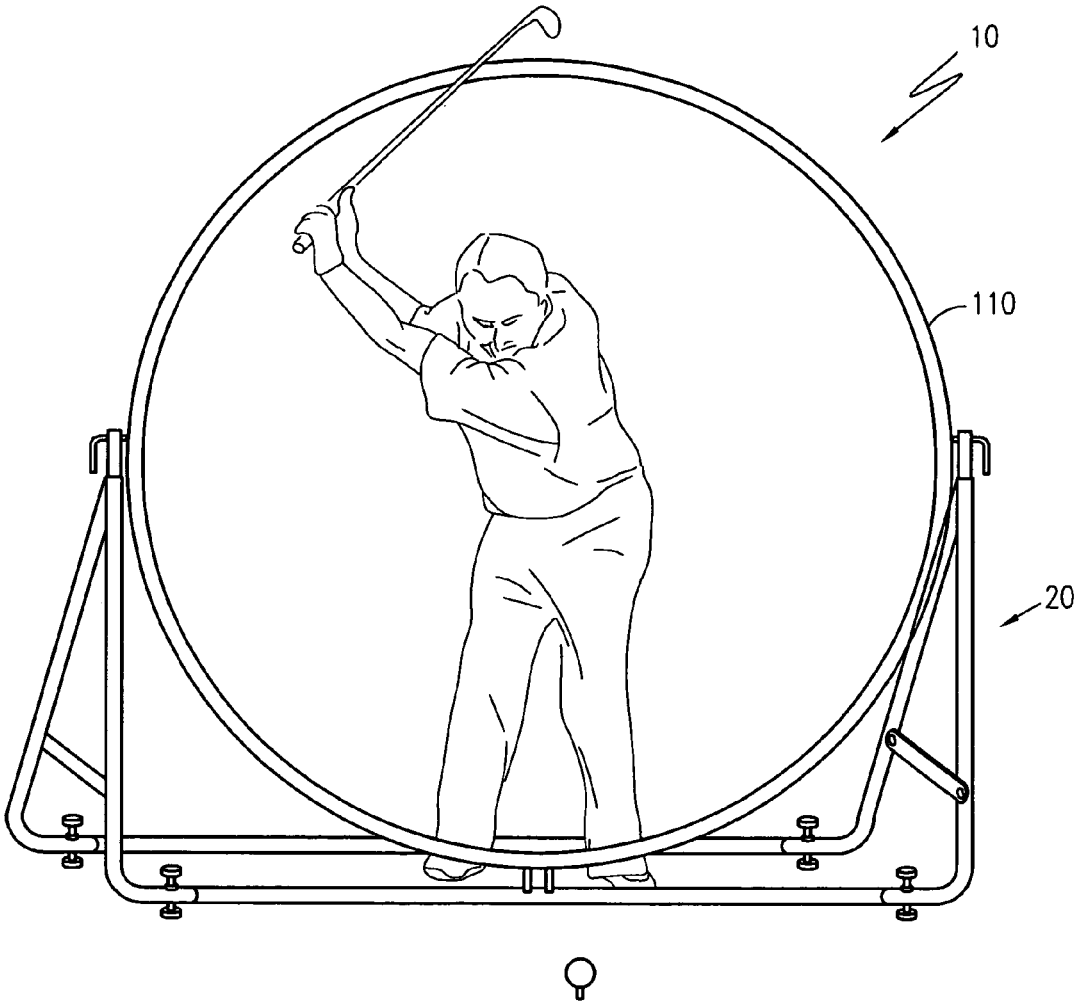
FIG. 1 is a perspective view of a golf swing training apparatus shown in use, according to the preferred embodiment of the present invention.
Figure 2:
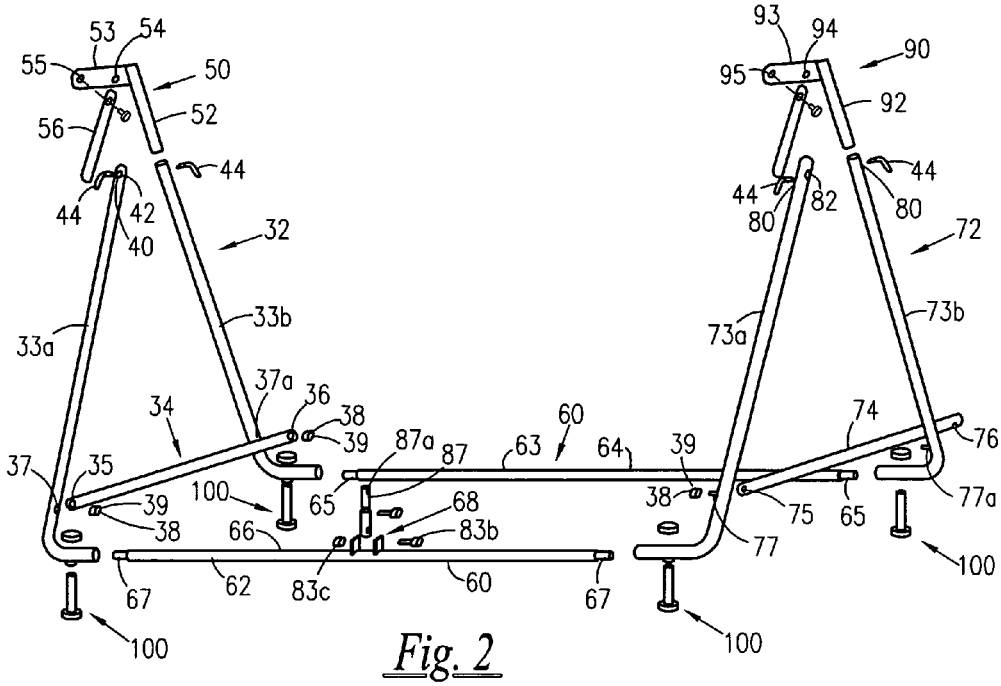
FIG. 2 is an exploded perspective view of the main frame assembly, according to the preferred embodiment of the present invention.
Figure 3:
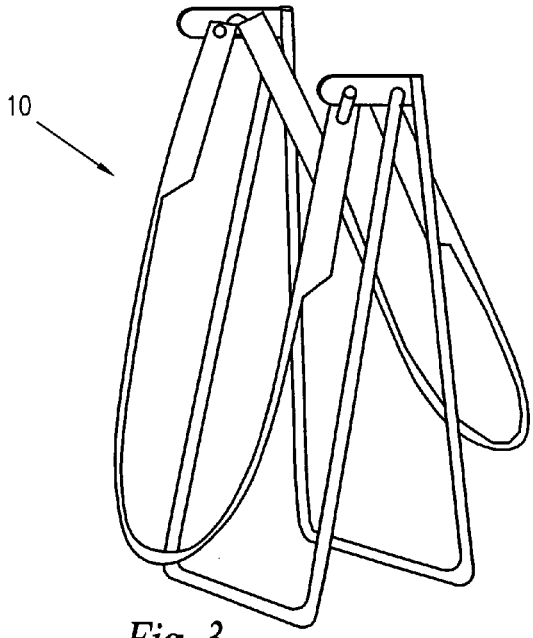
FIG. 3 is a perspective view of the golf swing training apparatus shown in a folded, collapsed state, according to the preferred embodiment of the present invention.

Referring now to FIGS. 1-3, a golf swing training apparatus 10 is shown, according to the present invention, comprising a main frame assembly 20 defining a pair of A-frames 30 joined by a pair of cross members 60. The pair of A-frames 30 includes a first A-frame 32 and a second A-frame 72, wherein first A-frame 32 defines a pair of elongated, tubular straight portions 33*a* , 33*b* and lower ends thereof bent at generally right angles to the straight portions 33*a*, 33*b*. The golf swing training apparatus 10 is adapted to be folded in a collapsed state to facilitate quick and easy transportation and storage.

A lumen 42 is provided in each straight portion 33*a*, 33*b* below an upper portion thereof, overwhich a threaded nut 40 is welded. The treaded nut 40 provides a threaded orifice through which a locking pin 44 threadedly engages, the function of which to be described later in greater detail. The straight portions 33*a*, 33*b* are connected with an elongated cross member 34 in a manner whereby straight portions 33*a*, 33*b* are fixedly positioned in a generally upright A-shaped configuration.

An end of cross member 34 includes an aperture 35 defined therethrough, and an opposing end of cross member 34 includes a recess 36. The aperture 35 of cross member 34 is adapted to mate with a bolt 37 welded perpendicularly above bend of lower end of straight portion 33*a*, and bolt 37*a* being welded perpendicularly above bend of lower end of straight portion 33*b* is adapted to reside within recess 36 of opposing end of cross member 34. Cross member 34 is secured to straight portion 33*a* and 33*b* via a fastener 38, such as a wing nut 39, which threadedly engages bolt 37 and 37*a*.

A first spar 50 is provided wherein first spar 50 is adapted to be slidably received by straight portion 33*b* through the upper opening thereof. The first spar 50 is defined as an elongated, circular post 52 having a spline 53 extending outwardly about an upper end thereof, thereby forming an obtuse angle with respect to post 52.

The vertical height of first spar 50 is easily adjusted by loosening locking pin 44 and moving post 52 of first spar 50 up or down to a selected height and threadedly re-engaging locking pin 44 with threaded nut 40, thereby facilitating telescopic adjustment.

The spline 53 of first spar 50 includes a first aperture 54 defined therethrough and being located proximal to post 52. The first aperture 54 serves to mount a first rod 56 to spline 53 via a fastener. The first rod 56 defines an perpendicularly above bend of lower end of straight portion 33*b* is adapted to reside within recess 76 of opposing end of cross member 74. Cross member 74 is secured to straight portion 73*a* and 73*b* via a fastener 38, such as a wing nut 39, which threadedly engages bolt 77 and 77*a*.

A second spar 90 is provided wherein second spar 90 is adapted to be slidably received by straight portion 73*b* through the upper opening thereof. The second spar 90 is defined as an elongated, circular post 92 having a spline 93 extending outwardly about an upper end thereof, thereby forming an obtuse angle with respect of post 92.

The vertical height of second spar 90 is easily adjusted by loosening locking pin 44 and moving post 92 of second spar 90 up or down to a selected height and threadedly re-engaging locking pin 44 with threaded nut 80, thereby facilitating telescopic adjustment.

The spline 93 of second spar 90 includes a first aperture 94 defined therethrough and being located proximal to post 92. The first aperture 94 serves to mount a second rod 96 to spline 93 via a fastener. The second rod 96 defines an elongated, cylindrical configuration and is adapted for telescopic adjustment. A lower end of second rod 96 is adapted to be slidably inserted within straight portion 73*a* along an upper opening thereof. The vertical height of second rod 96 is easily adjusted by loosening locking pin 44 at threaded nut 80 of straight portion 73*a* and moving second rod 96 up or down to a selected height and threadedly re-engaging locking pin 44 with threaded nut 80, thereby facilitating telescopic adjustment.

Figure 4:
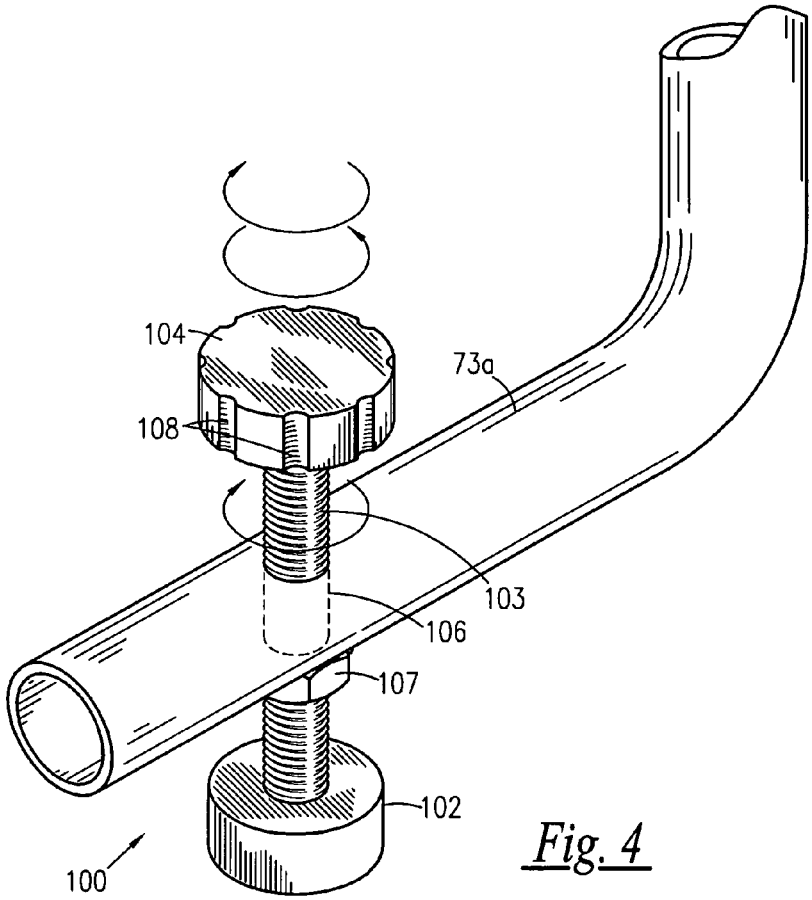
FIG. 4 is a side elevational view of an adjustable foot, according to the preferred embodiment of the present invention.
Figure 5:
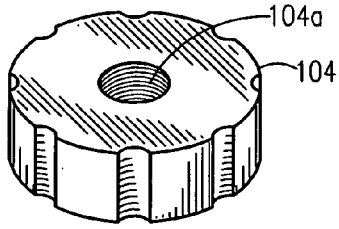
FIG. 5 is a bottom end perspective view of the rounded handle of the adjustable feet, according to the preferred embodiment of the present invention.

Referring now to FIGS. 2, and 4-5, in order to level the golf swing training apparatus 10 when placed atop uneven surfaces, a plurality of adjustable feet 100 are provided. The plurality of adjustable feet 100 are each defined of a disc 102 having an elongated, threaded member 103 welded vertically atop a center thereof. A rounded handle 104 or knob defines a threaded orifice 104*a* defined centrally therein which is adapted to mate with the elongated, threaded member 103 to which rounded handle 104 is tightened thereto. A lumen 106 is provided in each straight portion 33*a*, 33*b* of first A-frame 32 and in each straight portion 73*a*, 73*b* of second A-frame 72 below the bend portions thereof. A threaded nut 107 is welded atop each lumen 106 along an underside of each straight portion 33*a*, 33*b*, 73*a*, and 73*b*. The threaded nut 107 provides a threaded orifice through which the elongated, threaded member 103 threadedly engages. After screwing the elongated, threaded member 103 through threaded nut 107 and lumen 106, the rounded handle 104 is threadedly engaged with elongated, threaded member 103 so as to be tightened thereto. Being tightened to the elongated, threaded member 103, the rounded handle 104 is rotatable clockwise or counterclockwise to facilitate spiral rotation of elongated, threaded member 103 in a downward or upward position, respectfully, thereby allowing for selective vertical adjustment of disc 102 to facilitate leveling of golf swing training apparatus 10 atop an uneven surface. To facilitate a firm grasp of rounded handle 104, rounded handle 104 is provided with a series of vertically-oriented, gripping channels 108 formed about an external circumferentail surface thereof.

Figure 6:
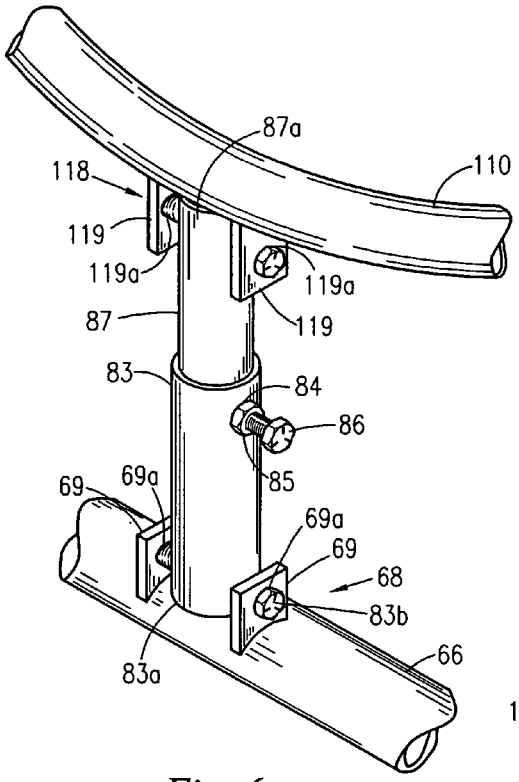
FIG. 6 is a perspective view showing guide ring's telescopic attachment to the front cross member via the cylindrical sleeve, according to the preferred embodiment of the present invention.
Figure 7:
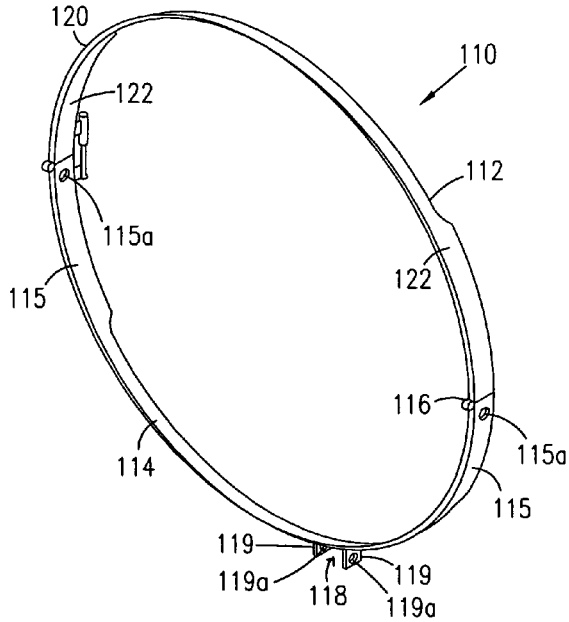
FIG. 7 is a perspective view of the guide ring, according to the preferred embodiment of the present invention.
Figure 8:
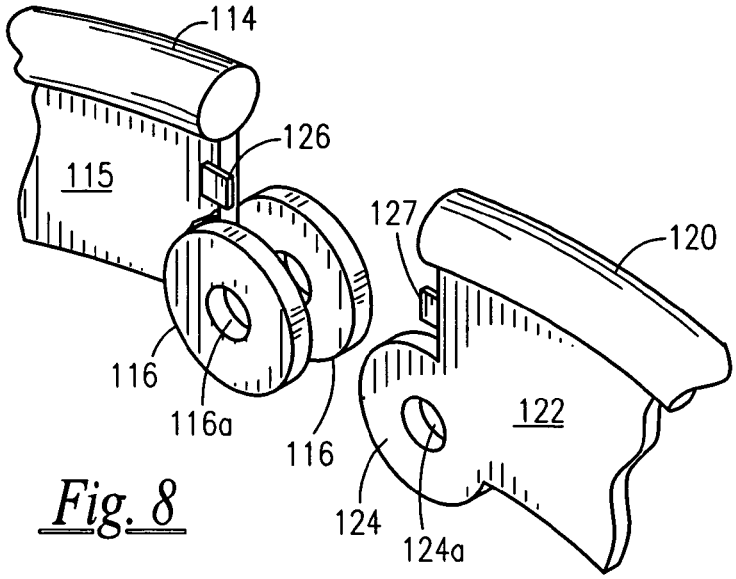
FIG. 8 is a perspective view of the annular member illustrating the first and second hinge elements thereof, shown without guide ring compression apparatus.
Figure 9:
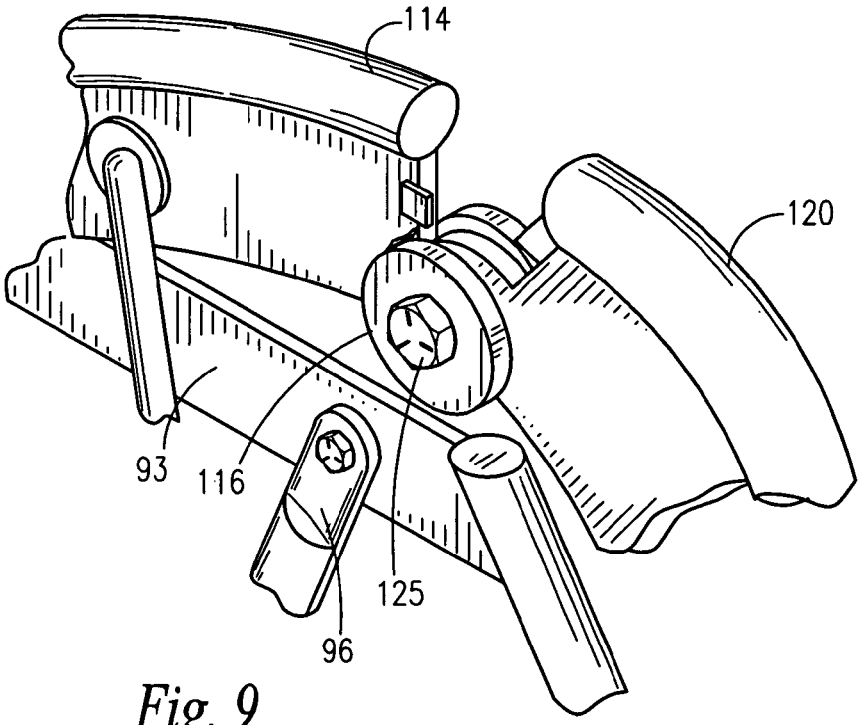
FIG. 9 is a perspective view of the annular member illustrating hinged attachment of the two semi-spherical segments thereof, shown without guide ring compression apparatus.
Figure 10:
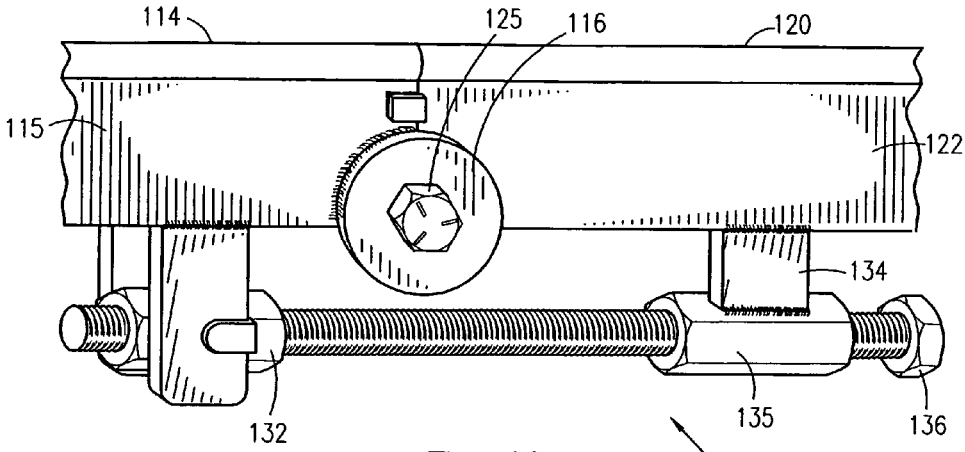
FIG. 10 is a side elevational view of the guide ring compression apparatus, according to the preferred embodiment of the present invention.
Figure 11:
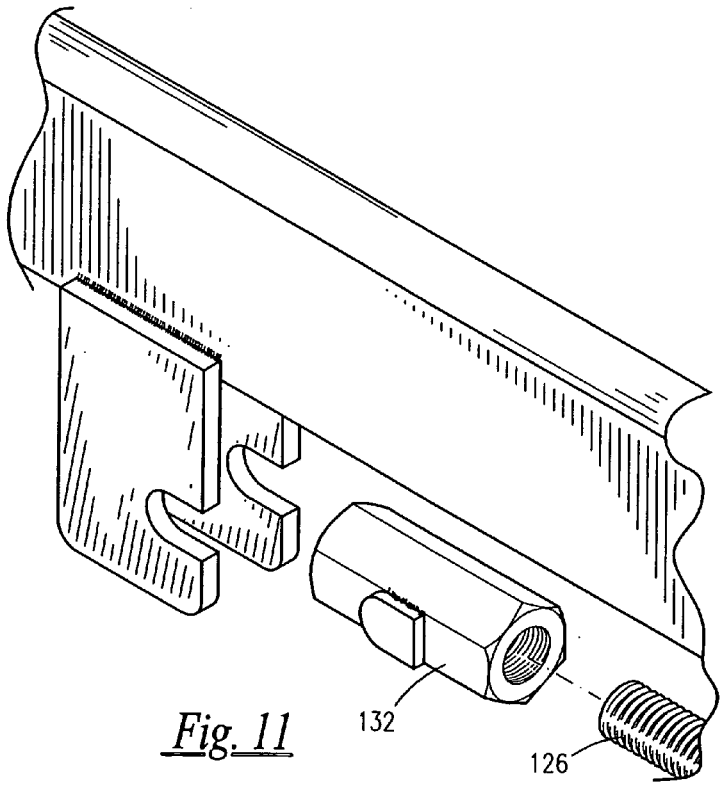
FIG. 11 is a perspective view of the threaded ferrule and threaded screw of the guide ring compression apparatus, according to the preferred embodiment of the present invention.
Figure 12:
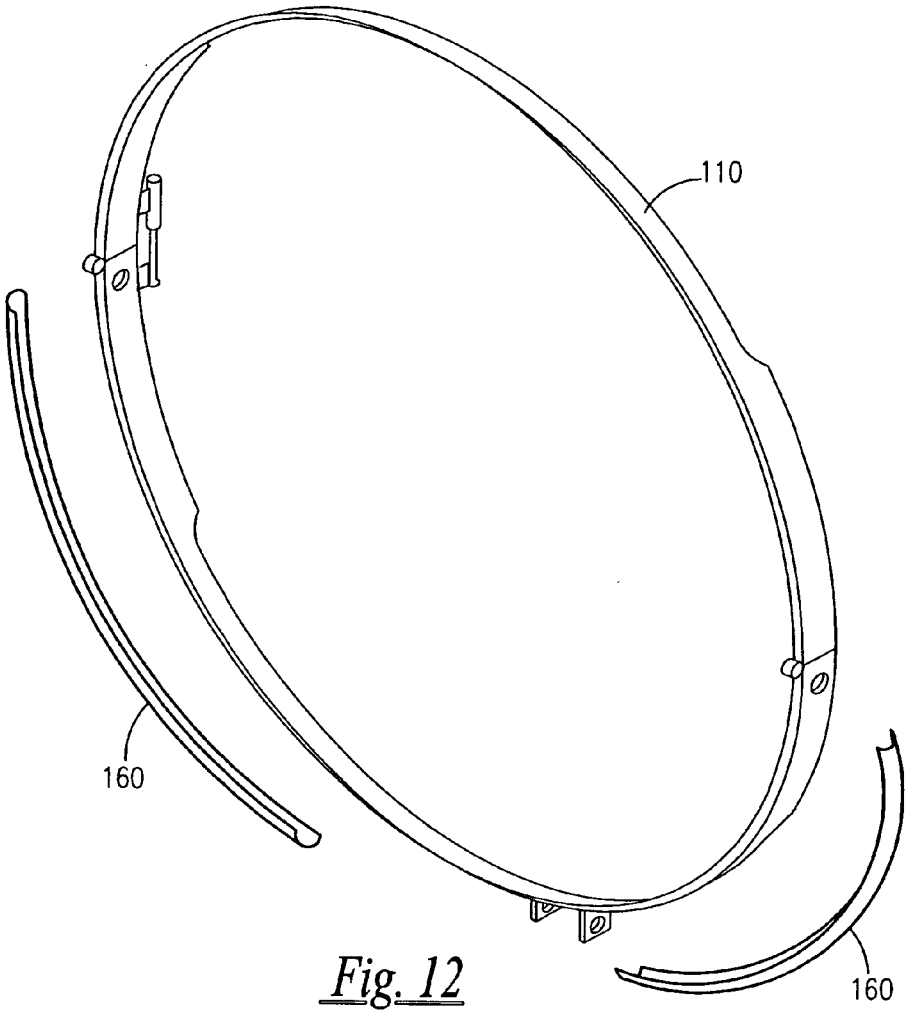
FIG. 12 is a perspective view of the plurality of guide ring liners, according to the preferred embodiment of the present invention.
Figure 13:
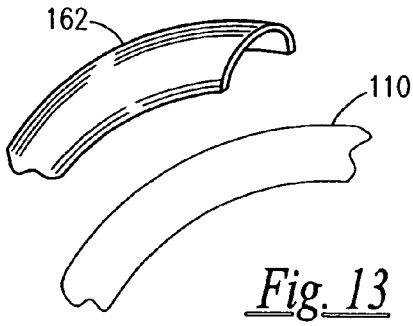
FIG. 13 is a partial side elevational view of an elongated, arcuate-shaped strip.

Referring now to FIGS. 2, 6 and 7, the pair of cross members 60 joining the pair of A-frames 30 are comprised of a front cross member 62 and a rear cross member 63. The rear cross member 63 is defined of an elongated, cylindrical main portion 64 having opposed ends terminating into narrow shaft portions 65, wherein narrow shaft portions 65 having a smaller diametrical measure with respect to elongated, cylindrical main portion 64. The narrow shaft portions 65 are adapted for snug insertion within a lower opening of straight portion 33*b* of first A-frame 32, and within a lower opening of straight portion 73*b* of second A-frame 72.

The front cross member 62 is defined of an elongated, cylindrical main portion 66 having opposed ends terminating into narrow shaft portions 67, wherein narrow shaft portions 67 having a smaller diametrical measure with respect to elongated, cylindrical main portion 66. The narrow shaft portions 67 are adapted for snug insertion within a lower opening of straight portion 33*a* of first A-frame 32, and within a lower opening of straight portion 73*a* of second A-frame 72, thereby tautly joining the pair of A-frames 30.

The front cross member 62 further defines a bracket 68 comprised of a pair of flanges 69 being adjacently-aligned and welded atop the elongated, cylindrical main portion 66 about an elongated centerline thereof. The flanges 69 are each provided with an aperture 69*a* defined therethrough and which are in linear alignment. The bracket 68 is adapted to rotatably support an elongated, cylindrical sleeve 83 between the pair of flanges 69 of bracket 68. The sleeve 83 includes a pair of apertures 83*a* defined along opposed external circumferential sidewalls of sleeve 83 near a bottom thereof, wherein apertures 83*a* are in linear alignment. A bolt 83*b* is inserted through flanges 69 of bracket 68 and through apertures 83*a* of sleeve 83, thereby allowing bracket 68 to rotatably support sleeve 83. A nut 83*c* is threadedly engaged to an end of bolt 83*b*. The sleeve 83 is adapted to slidably receive a guide ring support column 87. The sleeve 83 includes a hole 84 defined through an external circumferential sidewall thereof, along an upper portion thereof, over which a threaded nut 85 is welded. The threaded nut 85 provides a threaded orifice through which a locking knob 86 threadedly engages. The vertical height of guide ring support column 87 is easily adjusted by loosening locking knob 86 and moving guide ring support column 87 up or down to a selected height and threadedly re-engaging locking knob 86 with threaded nut 85, thereby facilitating telescopic adjustment. The guide ring support column 87 functions to rotatably support and allow for telescopic adjustment of a guide ring 110.

The guide ring support column 87 further includes a pair of apertures 87*a* defined along opposed external circumferential sidewalls of guide ring support column 87 near an upper portion thereof, wherein apertures 87*a* are in linear alignment. The function of apertures 87*a* will be described later in greater detail.

Referring more specifically to FIGS. 6-11, the guide ring 110 is defined of a collapsible, annular member 112 constructed from a rigid material. The annular member 112 is formed of two semi-spherical segments being hingedly attached. A first semi-spherical segment 114 includes downwardly-depending brackets 115 integrally formed therewith along both ends of the first semi-spherical segment 114. A first hinge element 116 is welded at a lower corner of each of the downwardly-depending brackets 115. The first hinge element 116 is adapted to mate with a second hinge element 124 of a second semi-spherical segment 120.

The second semi-spherical segment 120 includes downwardly-depending brackets 122 integrally formed therewith along both ends of second semi-spherical segment 120. A second hinge element 124 is welded at a lower corner of each of the downwardly-depending brackets 122. The second hinge element 124 is adapted to mate with first hinge element 116 of first semi-spherical segment 114. The second hinge element 124 mates with first hinge element 116 in a manner wherein second hinge element 124 resides in mesial alignment with first hinge element 116. First hinge element 116 and second hinge element 124 are hingedly attached via a fastener 125 inserted through an apertures 116*a*, 124*a* defined through each hinge element 116, 124, respectively.

In order to facilitate proper positioning of first semi-spherical segment 114 in relation to second semi-spherical segment 120 during hinged rotation thereof, an alignment tab 126, 127 is welded to a sidewall of downwardly-depending brackets 115, 122 of first semi-spherical segment 114 and second semi-spherical segment 120, respectively, above the first and second hinge elements 116, 124, thereof, respectively. The alignment tabs 126 and 127 are welded so as to be positioned along opposing sidewalls of their respective downwardly-depending bracket 115, 122.

The first semi-spherical segment 114 and second semi-spherical segment 120 are compressed together and maintained in a compressed position, thereby forming the annular member 112, via a guide ring compression apparatus 130. The guide ring compression apparatus 130 comprises a threaded ferrule 132 welded below downwardly-depending bracket 115 of first semi-spherical segment 114. The guide ring compression apparatus 130 further comprises a dog 134 having a threaded body 135 adapted to threadedly receive an elongated threaded screw 136 therethrough. The dog 134 is welded below downwardly-depending bracket 122. Once threaded through threaded body 135 of dog 134, the screw 136 mates with threaded ferrule 132, thereby causing first semi-spherical segment 114 and second semi-spherical segment 120 to pivot upward about fastener 125 until a state of compression is reached therebetwen and maintained thereat. In order to release compression between first semi-spherical segment 114 and second semi-spherical segment 120, the screw 136 is reverse threaded or rotated in an opposite direction.

The first semi-spherical segment 114 further defines a bracket 118 comprised of a pair of flanges 119 being adjacently-aligned and welded about a lower curvature of first semi-spherical segment 114. The flanges 119 are each provided with an aperture 119*a* defined therethrough and which are in linear alignment.

In order for guide ring support column 87 to rotatably support and allow for telescopic adjustment of guide ring 110, the upper portion of guide ring support column 87 is placed between bracket 118 of first semi-spherical segment 114, and the aperture 119*a* of each flange 119 of bracket 118 is aligned with apertures 87*a* of guide ring support column 87, whereupon a fastener is inserted through said apertures 119*a* and 87*a* so as to facilitate rotatable connection by first semi-spherical segment 114 with guide ring support column 87. Connection by first semi-spherical segment 114 with guide ring support column 87 allows for easy telescopic adjustment of first semi-spherical segment and hence guide ring 110 via loosening locking knob 86 and moving guide ring support column 87 up or down to a selected height and threadedly re-engaging locking knob 86 with threaded nut 85.

After both hingedly attaching first semi-spherical segment 114 to second semi-spherical segment 120, and connecting first semi-spherical segment 114 to guide ring support column 87, the guide ring 110 is mounted to spline 53 of first spar 50 and spline 93 of second spar 90. The spline 53 of first spar 50 includes a second aperture 55 defined therethrough, wherein second aperture 55 is positioned adjacent to first aperture 54 and distal to post 52. The spline 93 of second spar 90 includes a second aperture 95 defined therethrough, wherein second apertures 95 is positioned adjacent to first aperture 94 and distal to post 92. Each of downwardly-depending brackets 115 of first semi-spherical segment 114 includes a circular opening 115*a* adapted to be placed in alignment with second aperture 55, 95 of each's respective spline 53, 93, so as to allow guide ring 110 to be detachably connected to the respective spar 50, 90 with support pins 140 which engage both the respective second aperture 55, 95 and circular opening 115*a*.

In order to prevent damage to the club head 152 of a standard golf club 150 during use of the present invention, a plurality of guide ring liners 160 are provided. The guide ring liners 160 are defined of elongated, arcuate-shaped strips 162 fabricated of a lightweight, rigid material adapted to be snap fastened over an external circumferential surface of guide ring 110. It is envisioned that guide ring liners 160 are fabricated of polyvinyl chloride.

Figure 14:
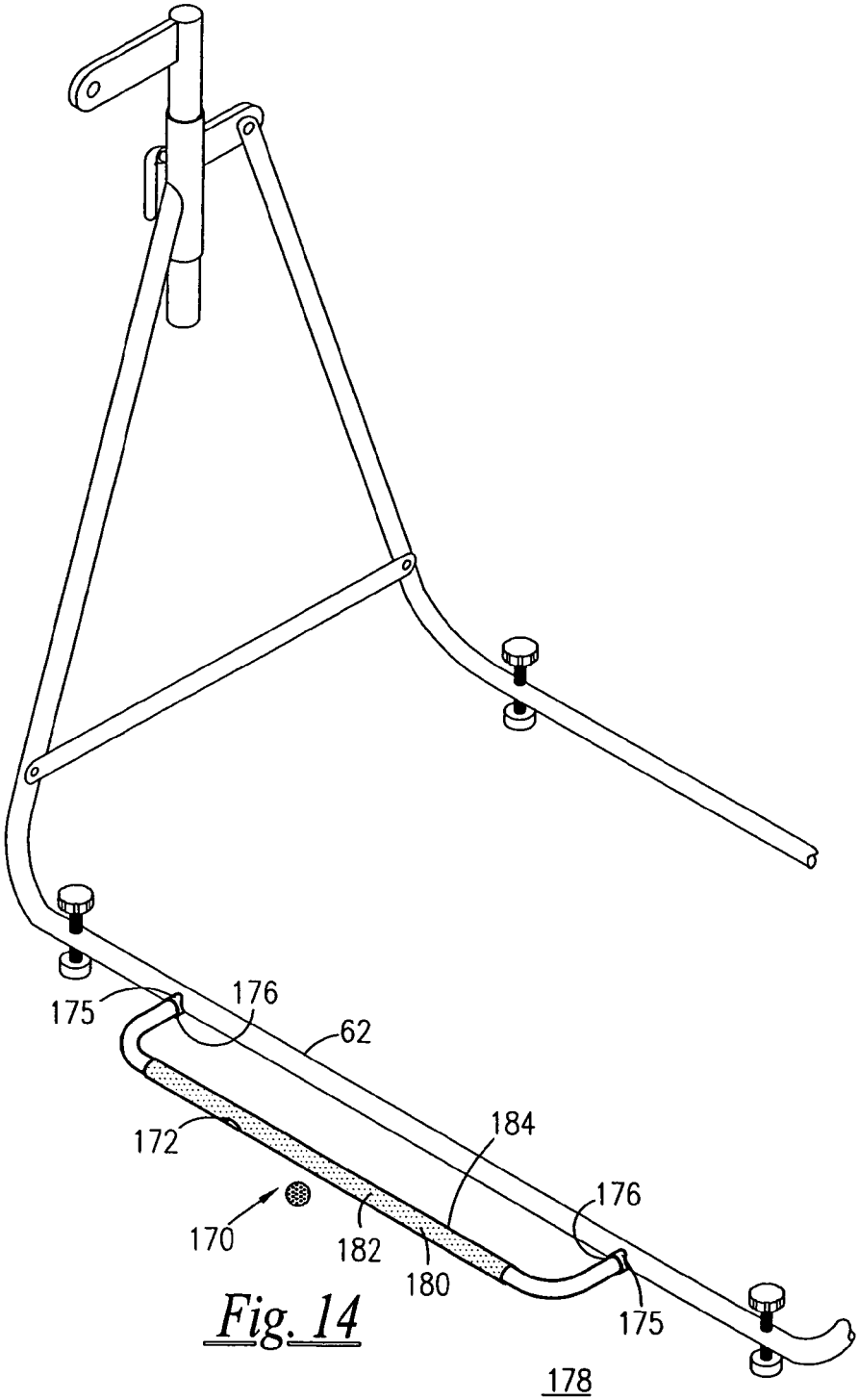
FIG. 14 is a perspective view of a putting guide rail.

Referring now to FIG. 14, a putting guide rail 170 is disclosed. The putting guide rail 170 is formed of a rigid, tubular material having an elongated straight portion 172 and opposite ends thereof bent at right angles to straight portion 172. A pair of bosses 175 are integrally molded with the front cross member 62 and extend outwardly to a horizontal plane being generally parallel with a support surface 178 or ground. The opposite ends of guide rail 170 are inserted respectively in the pair of bosses 175 which are provided with circular slots 176 adapted so as to receive opposite ends. The circular slots 176 are sizably adapted so as to frictionally hold opposite ends of guide rail 170 via mechanical interference.

A guide rail liner 180 defined of an elongated, arcuate-shaped strip 182 is provided. The guide rail liner 180 is fabricated of a lightweight, rigid material adapted to be snap fastened over an external circumferentail surface of straight portion 172. It is envisioned that guide rail liner 180 is provided with indicia 184 to enable user to gauge a length of his or her practice puts, chipping strokes, and the like.

Figure 15:
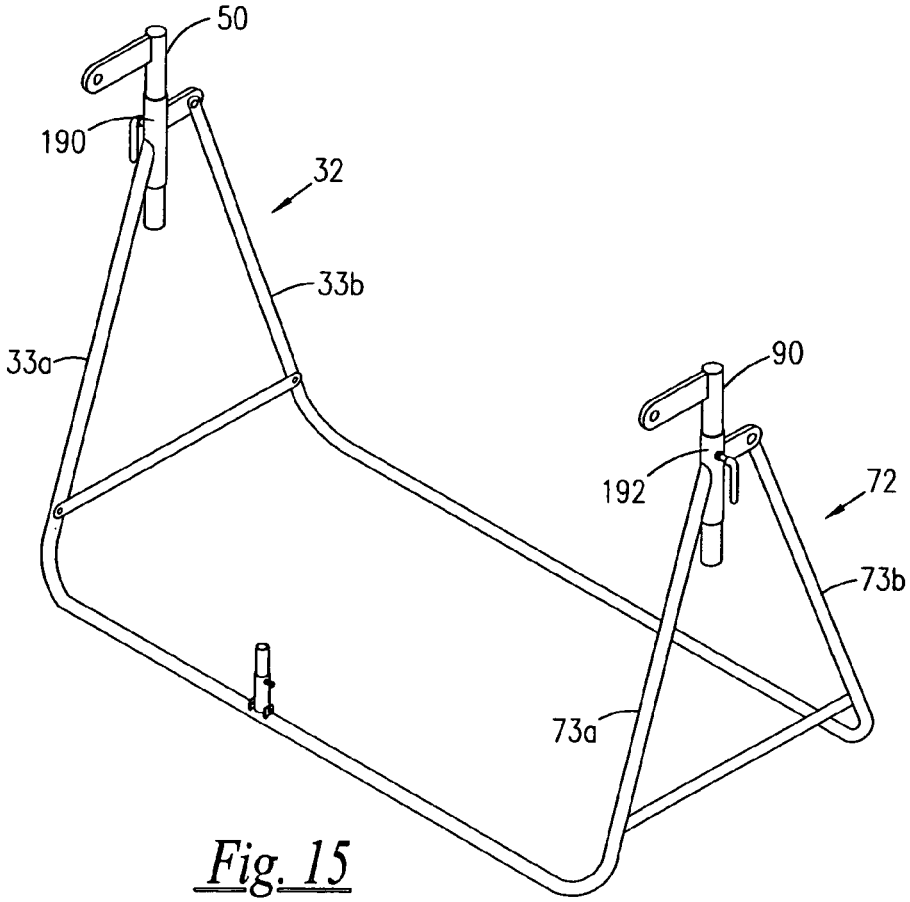
FIG. 15 is a perspective view of a first alternate embodiment of the present invention.
Figure 16:
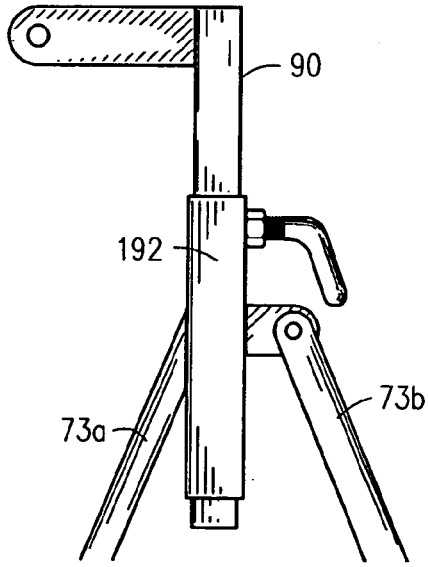
FIG. 16 is a side elevational view of the first alternate embodiment illustrating telescopic reception of spar by tubular member.
Figure 17:
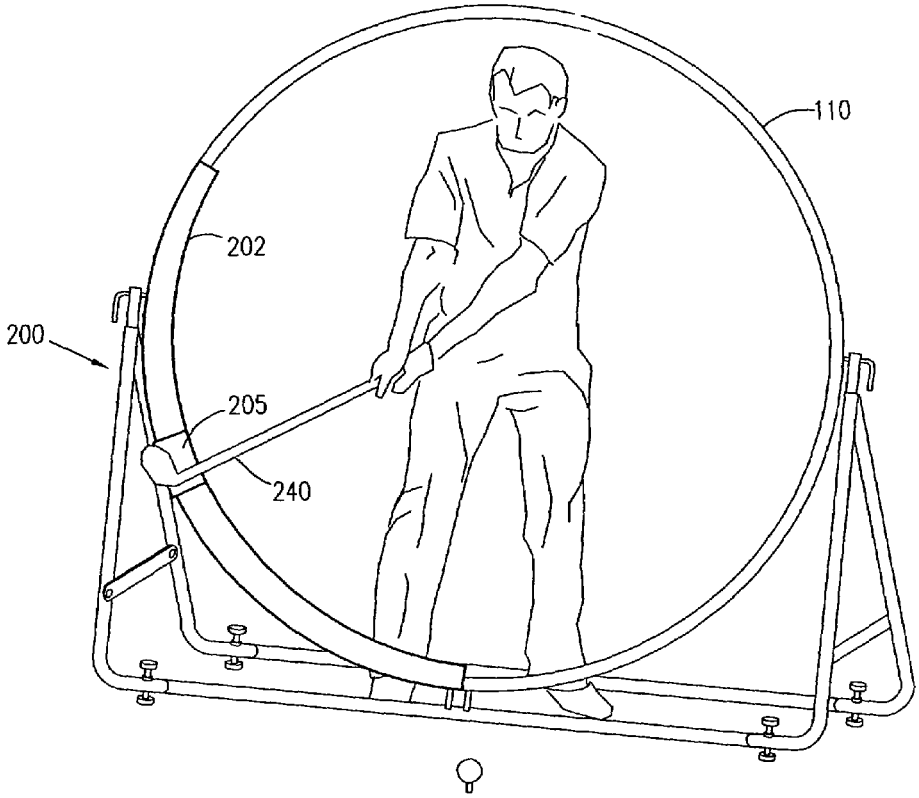
FIG. 17 is a perspective view of a second alternate embodiment of the present invention.
Figure 18:
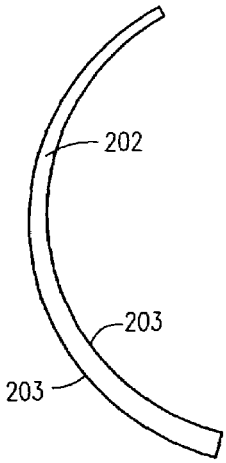
FIG. 18 is a side elevational view of the arcuate-shaped track, according to the second alternate embodiment of the present invention.
Figure 19:
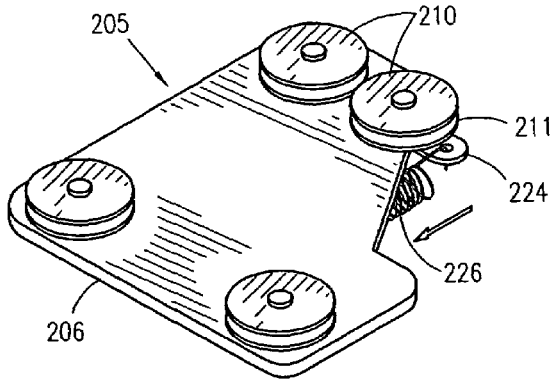
FIG. 19 is a perspective view showing the lower side of the stroke resistor mechanism, according to the second alternate embodiment of the present invention.
Figure 20:
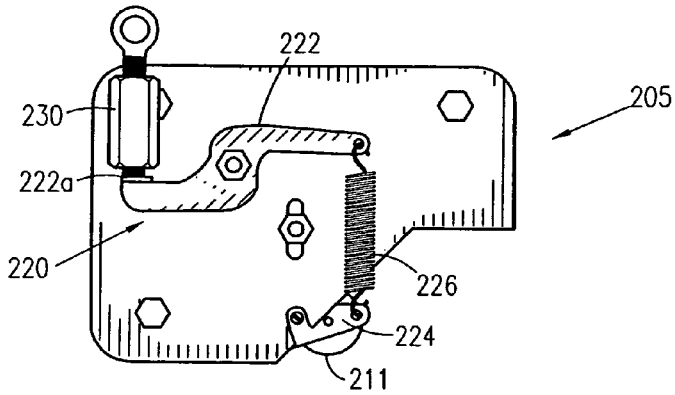
FIG. 20 is a top side elevational view of the stoke resistor mechanism, according to the second alternate embodiment of the present invention.
Figure 21:
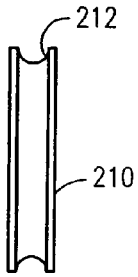
FIG. 21 is a side elevational view showing the grooved outer rim of a pulley, according to the second alternate embodiment of the present invention.
Figure 23:
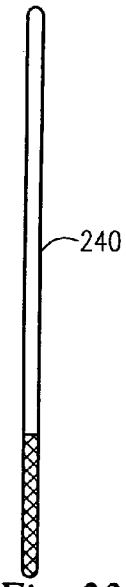
FIG. 23 is a perspective view of the elongated, tapered shaft, according to the second alternate embodiment of the present invention.
Figure 22:
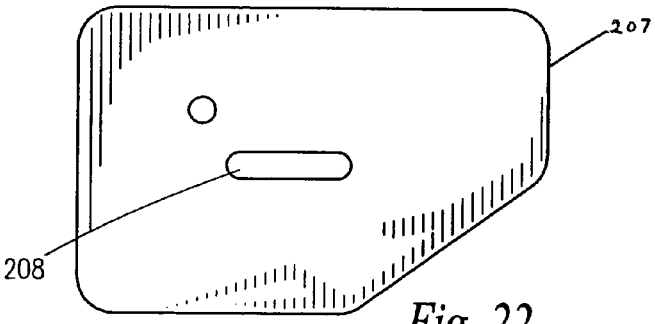
FIG. 22 is a top side elevational view of the cover plate, according to the second alternate embodiment of the present invention.
Figure 24:
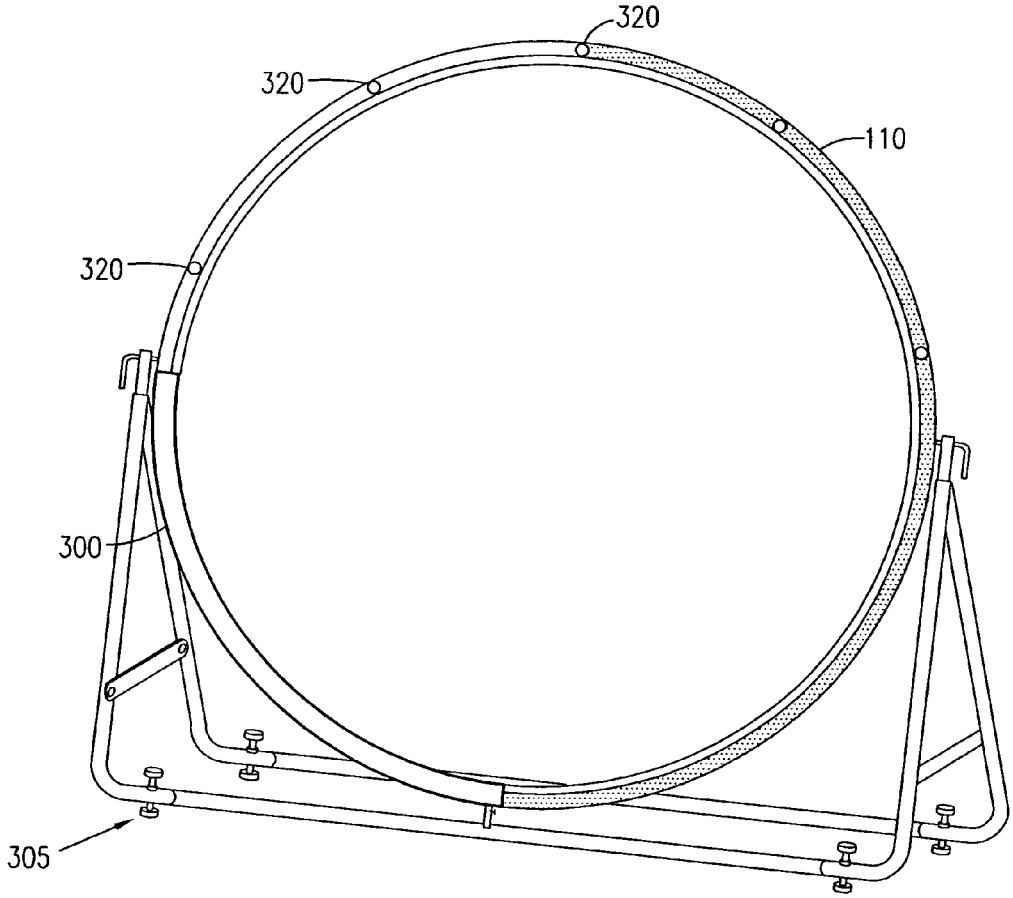
FIG. 24 is a perspective view of the present invention incorporated with a color-coded guide ring, according to the preferred embodiment of the present invention.
Figure 25:
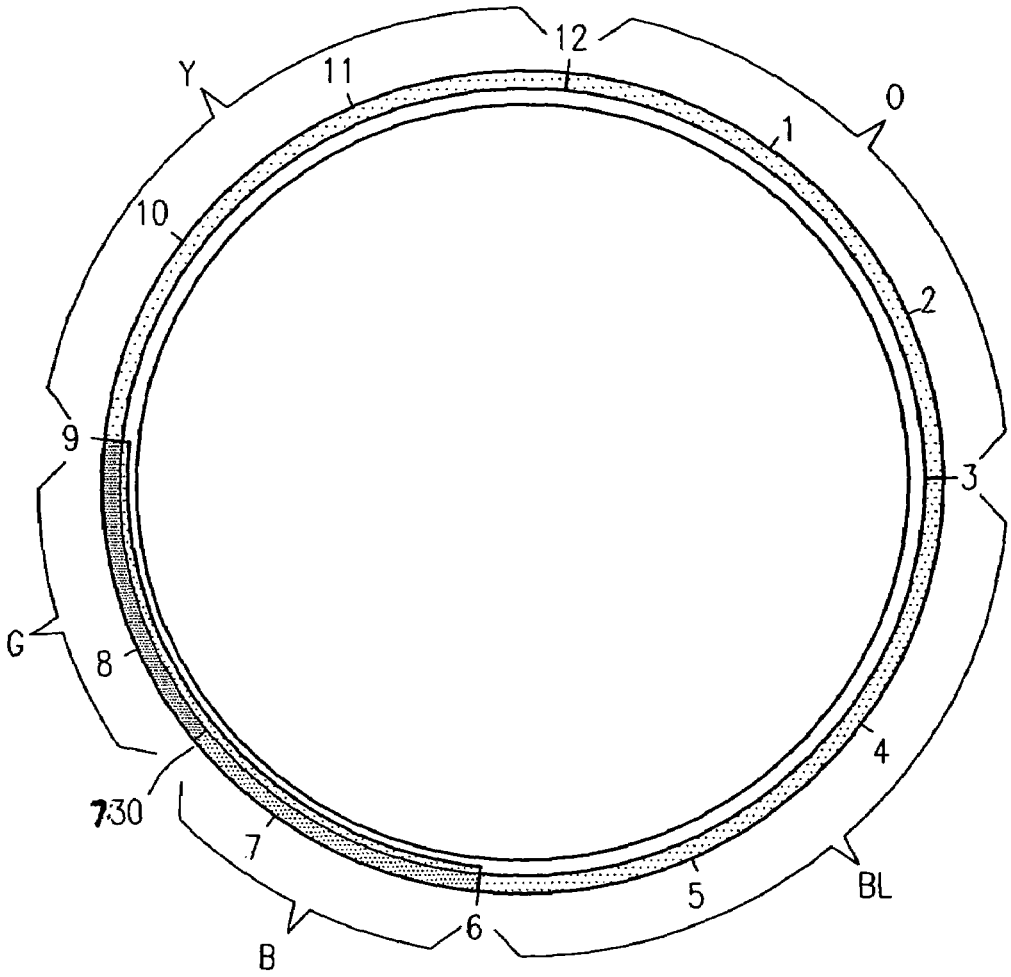
FIG. 25 is a side elevational view of the color-coded guide ring.

Referring now to FIGS. 15 and 16, a first alternate embodiment of the present invention is disclosed, wherein the pair of elongated, tubular straight portions 33*a*, 33*b* of first A-frame 32 and the pair of elongated, tubular straight portions 73*a*, 73*b* of second A-frame 72 are connectively joined along upper ends thereof. In addition, first spar 50 and second spar 90 are each telescopically received respectfully by tubular member 190, 192 welded vertically to an external circumferential surface of straight portions 33*a* and 73*a*, respectfully.

Referring now to FIGS. 17-23, a second alternate embodiment of the present invention is disclosed, wherein a stroke resistance assembly 200 is provided. The stroke resistance assembly 200 comprises an arcuate-shaped track 202 adapted to be removably coupled to guide ring 110 about an innermost external circumferential surface thereof.

The stroke resistance assembly 200 further comprises a stroke resistor mechanism 205 which slides along track 202 and can be adjusted to increase or decrease the degree of resistance provided thereby. The mechanism 205 comprises a mounting plate 206 having a lower side for rotatably supporting a plurality of pulleys 210 whose rotating force is controlled via a spring-biased linkage assembly 220. The spring-biased linkage assembly 220 is mounted to an upper side of mounting plate 206. The linkage assembly 220 includes a fulcrum lever 222 pivotally mounted to upper side of mounting plate 206. The fulcrum lever 222 is coupled to a control arm 224 via an extension spring 226. Control arm 224 is pivotally connected to mounting plate 206, wherein control arm 224 has a first pulley 211 of the plurality of pulleys 210 rotatably mounted thereto. Extension spring 226 is stretched via a manually-operated distender mechanism 230 which is adapted to engage a seat 222*a* of fulcrum level 222, thereby changing an applied force to first pulley 211 via control arm 224 and actuating a decrease in the torque of first pulley 211, the purpose of which to be described below in greater detail.

The track 202 includes lateral shoulder 203 adapted to mesh with a grooved outer rim 212 of each pulley 210. User adjusts distender mechanism 230 to restrain slidable movement of stroke resistor mechanism 205 across track 202. The distender mechanism 230 is adjustable to provide for various degrees of slidable resistance according to user preference. A cover plate 207 is mounted over mounting plate 206. The cover plate 207 is provided with a slot 208 through which an elongated, tapered shaft 240 resembling a standard golf club 150 shaft is inserted. User then performs a stoke by swinging the elongated, tapered shaft 240 upward and then swinging it downward throughout a swing plane. The stroke resistor mechanism 205 facilitates increased resistance being applied against user's downward stroke as mechanism 205 slides along track 202.

2. Method of Use

Referring specifically to FIGS. 24-32B, the preferred embodiment of the present invention is incorporated with a color-coded guide ring 110 adapted to serve as a visual as well as a functional guide to allow user to practice golf strokes by performing such strokes in a proper swing plane. The method for using the golf swing training apparatus 10 is disclosed henceforth.

Before applying the method, the guide ring 110 should be angularly and vertically adjusted according to the earlier described procedure so as to accommodate user's height. In addition, the present invention should be placed upon a level surface before use. Thus, if apparatus 10 is placed atop an uneven surface, user should rotatably engage the plurality of adjustable feet 100 to level the apparatus 10.

The guide ring 110 is provided with multi-colored bands 300 being annularly painted atop an outer surface thereof in a sequential manner. Indicia 320 is also disposed annularly atop guide ring's 110 outer surface so as to represent standard clock hours, the purpose of which to be described later in greater detail. The indicia 320 is illustrated herein as numerals "1" through "12" in sequential clockwise order. Each colored band 300 corresponds to proper hand and wrist location when performing an entire golf stroke utilizing a standard golf club 150.

The multi-colored bands 300 comprise variously colored, arcuate segments defining differing lengths. A blue-colored segment, positioned between 6:00 and 7:30 on guide ring 110, is denoted as "B". A green-colored segment, positioned between 7:30 and 9:00, is denoted as "G". A yellow-colored segment, positioned between 9:00 and 12:00, is denoted as "Y". An orange-colored segment, positioned between 12:00 and 3:00, is denoted as "O". A black-colored segment, positioned between 3:00 and 6:00, is denoted as "BL". Finally, a red-colored segment is denoted as "R". The red-colored segment or "R" is positioned between 6:00 and 9:00 and is juxtapositional to "B" and "G".

Figure 26:
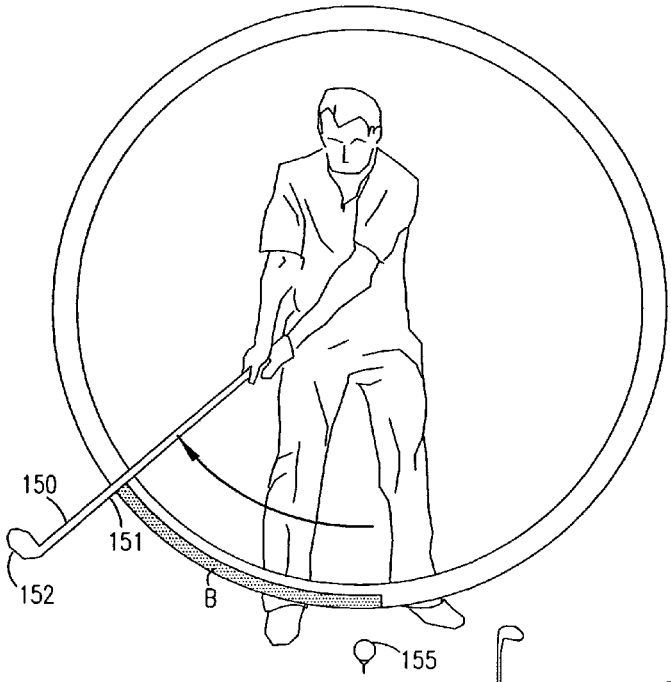
FIG. 26 is a perspective view illustrating the "takeaway drill"

Referring now to FIG. 26, the blue-colored segment is provided to allow user to practice a "takeaway drill". User practices his address and takeaway by twisting upper body while keeping hips stationary. User angles shoulders and twists back of upper torso while arms and wrists remain in a straight position. User keeps head positioned downward with eyes focused on golf ball 155. User then slidably engages a club shaft 151 of a standard golf club 150 upwardly and downwardly in a reciprocating manner across blue-colored segment of guide ring 110. User repeats slidable, reciprocative engagement of club 150 across blue-colored segment until developing a comfortable mastery thereof.

Figure 27:
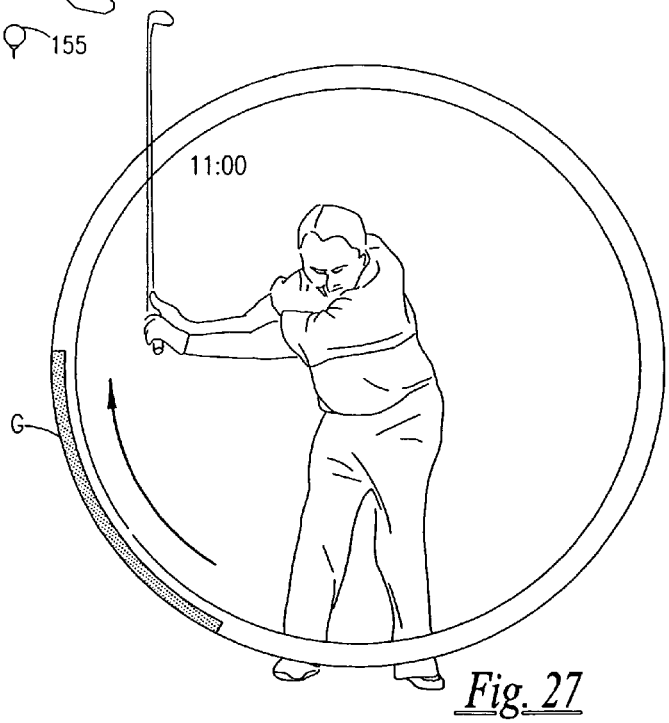
FIG. 27 is a perspective view illustrating the "wrist angle drill"

Referring now to FIG. 27, the green-colored segment is provided to allow user to practice a "wrist angle drill". User initiates the "wrist angle drill" by engaging club 150 at 7:30 of green-colored segment. User simultaneously pulls arms upwardly, coils both lower back and shoulders, and slightly pivots hips, while wrists curl gradually to a supinated position upon reaching a 9:00 position of green-colored segment, and while club 150 intersects guide ring 110 at an 11:00 position. User repeats the "wrist angle drill" until developing a comfortable mastery thereof. Once user masters "wrist angle drill", user practices the takeaway drill and wrist angle drill in combination as a single drill.

Figure 28:
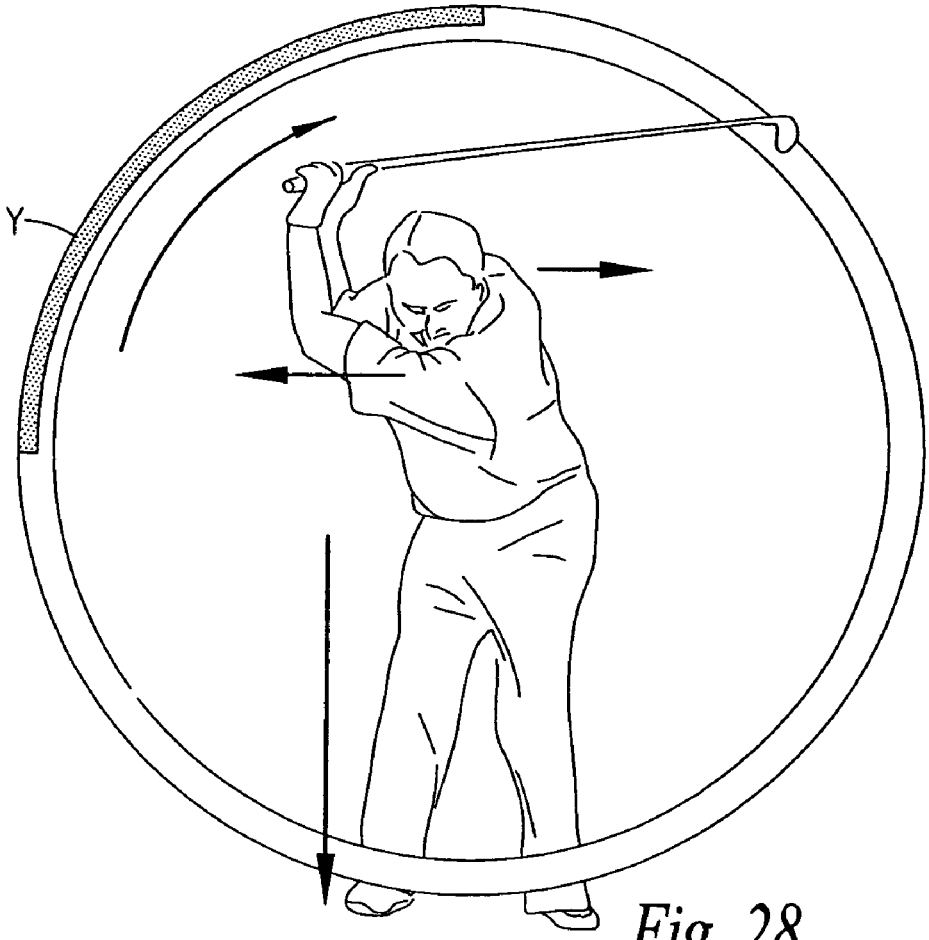
FIG. 28 is a perspective view illustrating the "coil drill"

Referring now to FIG. 28, the yellow-colored segment is provided to allow user to practice a "coil drill". User practices the "coil drill" by starting club 150 at a 9:00 position of yellow-colored segment. User draws body back in a backswing as far possible without undue strain. User curls back arms, wrists, shoulders, and hips in a smooth manner while shifting body weight to user's right leg until reaching a full-coiled position, while keeping elbows close to user's body and maintaining left arm in a straight alignment. User repeats the "coil drill" until developing a comfortable mastery thereof. Once user masters "coil drill", user practices the "takeaway drill", the "wrist angle drill" and the "coil drill" in combination as a single drill.

Figure 29A:
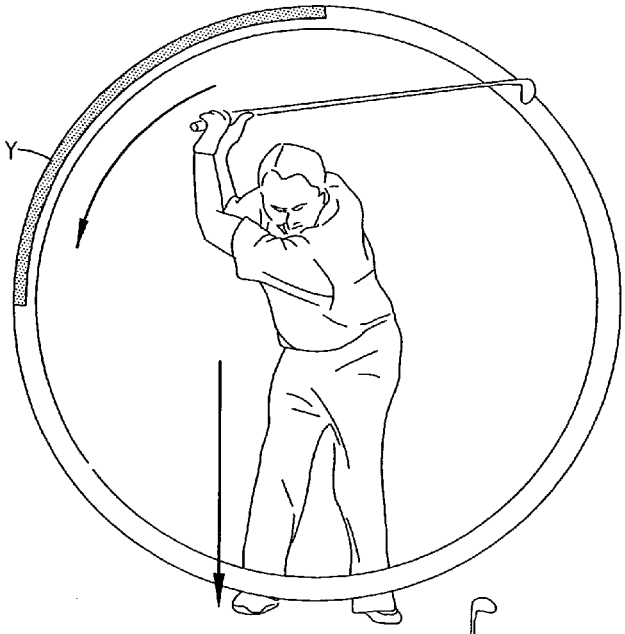
FIGS. 29A and 29B are perspective views illustrating the "descent drill"
Figure 29B:
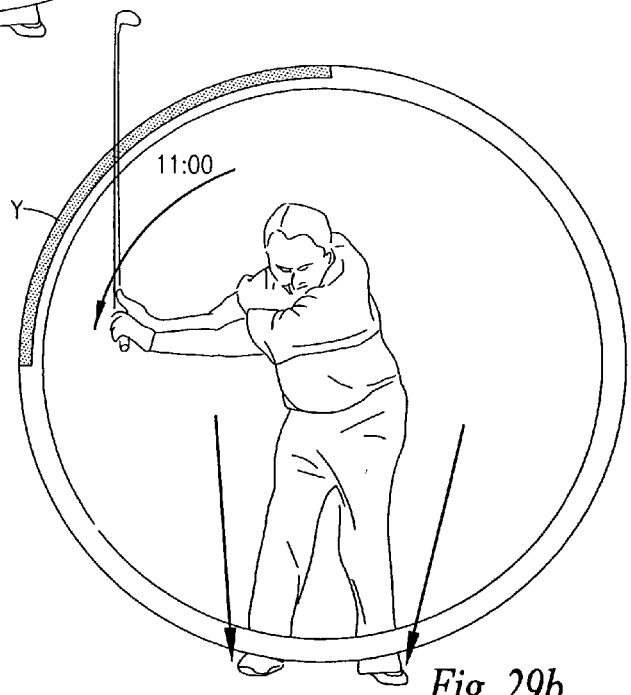

Referring now to FIGS. 29A and 29B, the yellow-colored segment is further provided to allow user to practice the "descent drill". User initiates the "descent drill" upon reaching said full-coiled position of "coil drill". While engaging club 150 against yellow-colored segment, user unwinds body and arms by reverse-pivoting user's hips, shoulders, and then arms, while shifting body weight from right foot to left foot, until user's wrist reaches 9:00 of red-colored segment. User repeats the "descent drill" until developing a comfortable mastery thereof.

Figure 30A:
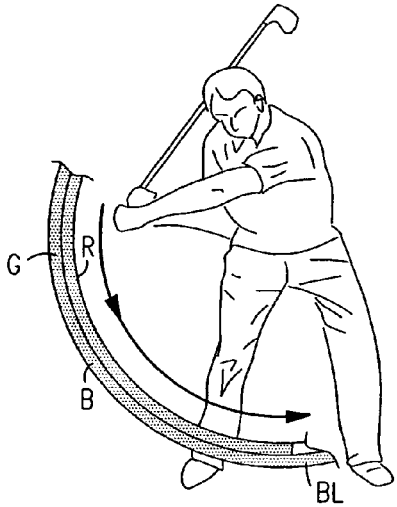
FIGS. 30A and 30B are perspective views illustrating the "down swing drill"
Figure 30B:
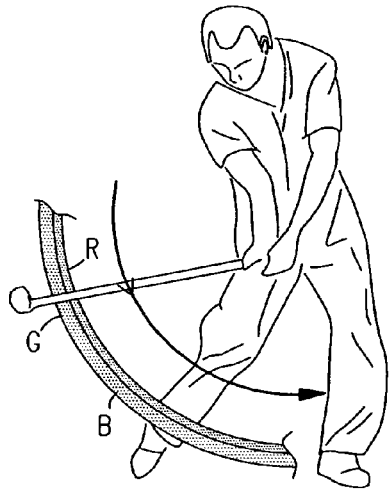

Referring now to FIGS. 30A and 30B, the red-colored segment is provided to allow user to practice a "down swing drill". User practices the "down swing drill" by placing hands at the 9:00 position of the red-colored segment, while club 150 intersects guide ring 110 at 11:00, and while equalizing body weight to both legs. User swings quickly downward whereupon body weight is simultaneously shifted quickly to user's left foot and user's wrists are gradually straightened until club 150 intersects red-colored segment at 6:00. While performing the "down swing drill", user is instructed to ensure left arm and club 150 is linearly aligned with golf ball 155 just before impact therewith. In addition, user is instructed to ensure club head 152 is in flush alignment with golf ball 155 and that approximately ninety percent of user's body weight resides on user's left foot. Further, user's head is kept in a downward position and slightly behind golf ball 155 at impact. User repeats the "down swing drill" until developing a comfortable mastery thereof. Once user masters the "down swing drill", user practices the "down swing drill" and the "descent drill" in combination at a single drill.

Figure 31:
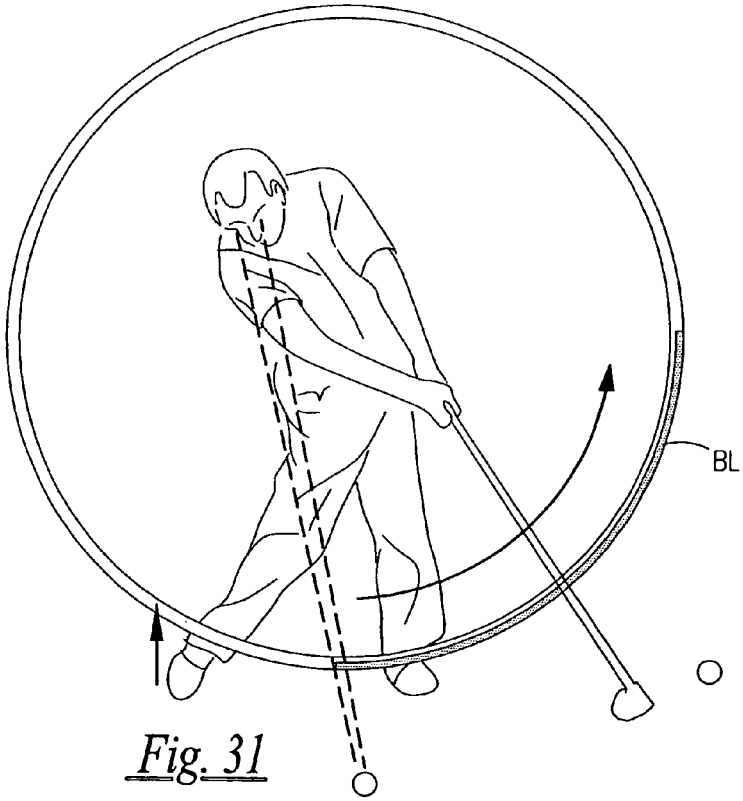
FIG. 31 is a perspective view illustrating the "impact drill"

Referring now to FIG. 31, the black-colored segment is provided to allow user to practice an "impact drill". User practices the "impact drill" by lifting user's right heel immediately after making contact with golf ball 155 so as to allow user's body to twist through the swing. As user swings through impact, user maintains head in a downward position while peering over right shoulder, and maintains both arms in a straight position until arms reach 3:00 of the black-colored segment. User maintains a substantial majority of body weight on user's left leg during completion of impact swing. User repeats the "impact drill" until developing a comfortable mastery thereof. Once user masters the "impact drill", user practices the "impact drill", the "down swing drill" and the "descent drill" in combination as a single drill.

Figure 32A:
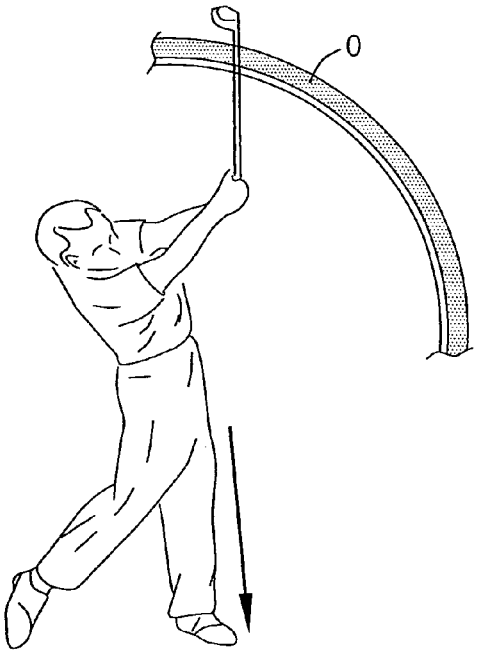
FIGS. 32A and 32B are perspective views illustrating the "completion drill".
Figure 32B:
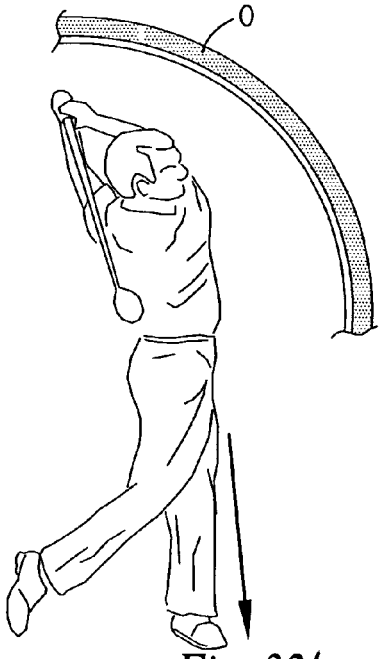

Referring finally to FIGS. 32A and 32B, the orange-colored segment is provided to allow user to practice a "completion drill". User practices the "completion drill" by starting club 150 at 3:00 of the orange-colored segment. User relaxes wrists and arms and coils upper torso over user's left shoulder while twisting body leftward to absorb energy of swing. User should be positioned such that user's back is relatively upright, upper torso is pointed toward a target, and golf club is positioned over user's left shoulder. User repeats the "completion drill" until developing a comfortable mastery thereof. Once user masters the "completion drill", user practices the "completion drill" and the "impact drill" in combination as a single drill.

3. Operation of the Preferred Embodiment

To use the present invention, user first places the present invention upon a level surface. Thus, if apparatus 10 is placed atop an uneven surface, user should rotatably engage the plurality of adjustable feet 100 to level the invention. Next, user angularly and vertically adjusts the guide ring 110 according to the earlier described procedure so as to accommodate user's height. Finally, in order to execute the ideal golf swing, user employs the aforementioned described method of "drills" in a successional manner until mastery thereof has been achieved.

The user of the present invention allows a user to execute the ideal golf swing in a manner which is quick, easy, and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teachings. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be broadly limited only by the following claims.

What is claimed is:

1. A golf swing training apparatus comprises:

a main frame assembly comprising a pair of A-frames joined by a pair of cross members comprised of a front cross member and a rear cross member adapted to be folded in a collapsed state to facilitate quick and easy transportation and storage; and a guide ring rotatably supported by said main frame assembly;

wherein said pair of A-frames defines a first A-frame and a second A-frame, both of which are defined by a pair of elongated, tubular straight portions and lower ends thereof bent at generally right angles to said straight portions and wherein each of said pair of straight portions of said first A-frame and said second A-frame is provided with a lumen located below an upper portion of each said pair of straight portions of said first A-frame and said second A-frame, and wherein said lumen has a threaded nut welded thereover, said threaded nut provides a threaded orifice through which a locking pin threadedly engages.

2. The golf swing training apparatus of claim 1, wherein said pair of straight portions of said first A-frame and said pair of straight portions of said second A-frame are each defined by a first straight portion and a second straight portion, said second straight portion of said first A-frame is adapted to slidably receive a first spar through an upper opening of said second straight portion, wherein said first spar is defined as an elongated, circular post having a spline extending outwardly about an upper end of said circular post in a manner such that said spline forms an obtuse angle with respect to said circular post, said first spar is vertically adjustable by loosening said locking pin and moving said circular post up or down to a selected height and threadedly re-engaging said locking pin with said threaded nut, thereby facilitating telescopic adjustment of said first spar.

3. The golf wing training apparatus of claim 2, wherein said spline of said first spar includes a first aperture defined therethrough and being located proximal to said circular post, said first aperture serves to mount a first rot to said spline via a fastener, wherein said first rod defines an elongated, cylindrical configuration and is adapted for telescopic adjustment, said first rod has a lower end adapted to be slidably inserted within said first straight portion of said first A-frame along an upper opening thereof, said first rod is vertically adjustable by loosening said locking pin at said threaded nut of said first straight portion and moving said first rod up or down to a selected height and threadedly re-engaging said locking pin with said threaded nut, thereby facilitating telescopic adjustment of said first rod.

4. The golf swing training apparatus of claim 2, wherein said second straight portion of said second A-frame is adapted to slidably receive a second spar through an upper opening of said second straight portion, wherein said second spar is defined as an elongated, circular post having a spline extending outwardly about an upper end of said circular post in a manner such that said spline forms an obtuse angle with respect to said circular post, said second spar is vertically adjustable by loosening said locking pin and moving said circular post up or down to a selected height and threadedly re-engaging said locking pin with said threaded nut, thereby facilitating telescopic adjustment of said second spar.

5. The golf swing training apparatus of claim 4, wherein said spline of said second spar includes a first aperture defined therethrough and being located proximal to said circular post, said first aperture serves to mount a second rod to said spline via a fastener, wherein said second rod defines an elongated, cylindrical configuration and is adapted for telescopic adjustment, said second rod has a lower end adapted to be slidably inserted within said first straight portion of said second A-frame along an upper opening thereof said second rod is vertically adjustable by loosening said locking pin at said threaded nut of said first straight portion and moving said second rod up or down to a selected height and threadedly re-engaging said locking pin with said threaded nut, thereby facilitating telescopic adjustment of said second rod.

6. The golf swing training apparatus of claim 1, wherein said front cross member is defined of an elongated, cylindrical main portion having opposed ends terminating into narrow shaft portions that comprise a smaller diametrical measure with respect to said elongated, cylindrical main portion, said narrow shaft portions are adapted for snug insertion within a lower opening of said first straight portion of said first A-frame, and within a lower opening of said first straight portion of said second A-frame, and wherein said rear cross member is defined of an elongated, cylindrical main portion having opposed ends terminating into narrow shaft portions that comprise a smaller diametrical measure with respect to said elongated, cylindrical main portion, said narrow shaft portions are adapted for snug insertion within a lower opening of said second straight portion of said first A-frame, and within a lower opening of said second straight portion of said second A-frame, thereby tautly joining said pair of A-frames, and wherein said front cross member further defines a bracket comprised of a pair of flanges being adjacently-aligned and welded atop said elongated, cylindrical main portion about an elongated centerline thereof, said flanges are each provided with an aperture defined therethrough and which are in linear alignment, said bracket is adapted to rotatably support an elongated, cylindrical sleeve between said pair of flanges of said bracket, said elongated, cylindrical sleeve includes a pair of apertures defined along opposed external circumferential sidewalls of said elongated, cylindrical sleeve near a bottom thereof, wherein said pair of apertures are in linear alignment, said pair of flanges of said bracket is inserted with a bolt which extends through said pair of apertures of said elongated, cylindrical sleeve, thereby allowing said bracket to rotatably support said elongated, cylindrical sleeve, said blot has an end threadedly engaged with a nut, said elongated, cylindrical sleeve is adapted to slidably receive a guide ring support column, said elongated, cylindrical sleeve includes a hole defined through an external circumferntail sidewall of said elongated, cylindrical sleeve, along an upper portion thereof, over which a threaded nut is welded, said threaded nut provides a threaded orifice through which a locking knob threadedly engages, wherein said guide ring support column is vertically adjustable by loosening said locking knob and moving said guide ring support column up or down to a selected height and threadedly re-engaging said locking knob with said threaded nut, thereby facilitating telescopic adjustment of said guide ring support column, said guide ring support column further includes a pair of apertures defined along opposed external circumferetial sidewalls of said guide ring support column near an upper portion thereof, wherein said pair of apertures are in linear alignment, and wherein said guide ring support column functions to rotatably support and allow for telescopic adjustment of said guide ring.

7. The golf swing training apparatus of claim 1, wherein said guide ring is defined of a collapsible, annular member constructed from a rigid material, said annular member is formed of two semi-spherical segments being hingedly attached.

8. The golf swing training apparatus of claim 7, wherein said annular member includes a first semi-spherical segment having downwardly-depending brackets integrally formed therewith along both ends of said first semi-spherical segment, said first semi-spherical segment is provided with a first hinge element welded at a lower corner of each of said downwardly-depending brackets.

9. The golf swing training apparatus of claim 8, wherein said first semi-spherical segment further defines a bracket comprised of a pair of flanges being adjacently-aligned and welded about a lower curvature of said first semi-spherical segment, said pair of flanges are each provided with an aperture defined therethrough and which are in linear alignment.

10. The golf swing training apparatus of claim 7, wherein said annular member further includes a second semi-spherical segment having downwardly-depending brackets integrally formed therewith along both ends of said second semi-spherical segment, said second semi-spherical segment is provided with a second hinge element welded at a lower corner of each of said downwardly-depending brackets, said second hinge element is adapted to mate with said first hinge element of said first semi-spherical segment, said second hinge element mates with first hinge element in a manner wherein said second hinge element resides in mesial alignment with said first hinge element, said first hinge element and said second hinge element are hingedly attached via a fastener inserted through an aperture defined through said first hinge element and said second hinge element, and wherein said downwardly-depending brackets of said first semi-spherical segment and said second semi-spherical segment are welded with an alignment tab along a sidewall of said downwardly-depending brackets of said first semi-spherical segment and said second semi-spherical segment, respectively, above said first hinge element and second hinge element, respectively, in order to facilitate proper positioning of said first semi-spherical segment in relation to said second semi-spherical segment during hinged rotation thereof, said alignment tab of said first semi-spherical segment and said second semi-spherical segment are welded so as to be positioned along opposing sidewalls of respective said downwardly-depending brackets.

11. The golf swing training apparatus of claim 10, wherein said first semi-spherical segment and said second semi-spherical segment are compressed together and maintained in a compressed position, thereby forming said annular member, via a guide ring compression apparatus.

12. The golf swing training apparatus of claim 10, wherein said first semi-spherical segment is rotatably connected to said guide ring support column by placing said upper portion of said guide ring support column between said bracket of said first semi-spherical segment, and wherein said aperture of each said flange of said bracket is aligned with said pair of apertures of said guide ring support column, whereupon a fastener is inserted through said aperture of each said flange of said bracket and said pair of apertures of said guide ring support column so as to facilitate rotatable connection by said first semi-spherical segment with said guide ring support column, whereby connection by said first semi-spherical segment with said guide ring support column allows for easy telescopic adjustment of both said first semi-spherical segment and said guide ring via loosening said locking knob and moving said guide ring support column up or down to a selected height and threadedly re-engaging said locking knob with said threaded nut.

13. The golf swing training apparatus of claim 7, wherein said guide ring is mounted to said spline of said first spar and said spline of said second spar, wherein said spline of said first spar includes a second aperture defined therethrough, wherein said second aperture is positioned adjacent to said first aperture and distal to said circular post, said spline of said second spar includes a second aperture defined therethrough, wherein said second aperture of said second spar is positioned adjacent to said first aperture thereof, and distal to said circular post, wherein each of said downwardly-depending brackets of said first semi-spherical segment includes a circular opening adapted to be placed in alignment with said second aperture of said spline of said first spar and in alignment with said second aperture of said spline of said second spar, so as to allow said guide ring to be detachably connected to said first spar and said second spar with support pins.

14. The golf swing training apparatus of claim 1, further comprising a plurality of guide ring liners, said guide ring liners are defined of elongated, arcuate-shaped strips fabricated of a lightweight, rigid material adapted to be snap fastened over an external circumstantial surface of said guide ring.

15. A golf swing training apparatus comprising:

a main frame assembly, said main frame assembly comprises a pair of A-frames joined by a pair of cross members, wherein said main frame assembly is adapted to be folded in a collapsed state to facilitate quick and easy transportation and storage;

a guide ring, said guide ring is rotatably supported by said main frame assembly;

a plurality of adjustable feet, said plurality of adjustable feet are coupled below said pair of A-frames; and a stroke resistance assembly, said stroke resistance assembly comprises an arcuate-shaped track adapted to be removably coupled to guide ring about an innermost external circumferential surface thereof, wherein said stroke resistance assembly further comprises a stroke resistor mechanism which slides along said track and is adjustable to increase or decrease a degree of resistance provided by said stroke resistor mechanism, said stroke resistor mechanism comprises a mounting plate having a lower side for rotatably supporting a plurality of pulleys, wherein said plurality of pulleys having a rotating force controlled via a spring-biased linkage assembly, said spring-biased linkage assembly is mounted to an upper side of said mounting plate, wherein said spring-biased linkage assembly includes a fulcrum lever pivotally mounted to an upper side of said mounting plate, said fulcrum lever is coupled to a control arm via an extension spring, said control arm is pivotally connected to said mounting plate, wherein said control arm has a first pulley of said plurality of pulleys rotatably mounted thereto, said extension spring is stretched via a manually-operated distender mechanism being adapted to engage a seat of said fulcrum lever, thereby changing an applied force to said first pulley via said control arm and actuating a decrease in torque of said first pulley, and wherein said track includes lateral shoulders adapted to mesh with a grooved outer rim of each plurality of pulleys, said distender mechanism is adapted to selectively restrain slidable movement of said stroke resistor mechanism across said track, and wherein said mounting plate has a cover plate mounted thereover, said cover plate is provided with a slot through which an elongated, tapered shaft is inserted, whereupon a stroke is performed by user by swinging said elongated, tapered shaft upward and then swinging said elongated, tapered shaft downward throughout a swing plane, and wherein said stroke resistor mechanism facilitates increased resistance being applied against user's sownard stroke as said stroke resistor mechanism slides along said track.

16. A method for using a golf swing training apparatus, comprising the steps of:

(1) placing said golf swing training apparatus upon a surface;

(2) rotatably engaging a plurality of adjustable feet to level said golf swing training apparatus, in the event said golf swing training apparatus is placed atop an uneven surface;

(3) adjusting a guide ring angularly and vertically so as to accommodate user's height, wherein said guide ring guide ring is provided with multi-colored bands being annularly painted atop an outer surface of said guide ring in a sequential manner, and wherein said guide ring further provides indicia disposed annularly atop an outer surface of said guide ring so as to represent standard clock hours, said indicia is defined as numerals "1" through "12" in sequential clockwise order, wherein said multi-colored bands multi-colored bands comprise variously colored, arcuate segments defining differing lengths, said arcuate segments comprise a blue-colored segment, positioned between 6:00 and 7:30 on said guide ring, a green-colored segment, positioned between 7:30 and 9:00, a yellow-colored segment, positioned between 9:00 and 12:00, an orange-colored segment, positioned between 12:00 and 3:00, a black-colored segment, positioned between 3:00 and 6:00, and a red-colored segment positioned between 6:00 and 9:00 and wherein said red-colored segment is juxtapositional to said blue-colored segment and said green-colored segment;

(4) twisting upper body while keeping hips stationary, angling shoulders and twisting back of upper torso while arms and wrists remain in a straight position, keeping head positioned downward with eyes focused on a golf ball, slidably engaging a club shaft of a standard golf club upwardly and downwardly in a reciprocating manner across said blue-colored segment, repeating slidable, reciprocative engagement of the club shaft across said blue-colored segment until developing a comfortable mastery of step (4);

(5) engaging the standard golf club at 7:30 of said green-colored segment while simultaneously pulling arms upwardly, coiling both lower back and shoulders, and slightly pivoting hips, while curling wrists gradually to a supinated position upon reaching a 9:00 position of said green-colored segment, and while the standard golf club intersects said guide ring at an 11:00 position, repeating step (5) until developing a comfortable mastery of step (5), and then practicing step (4) and step (5) in combination as a single drill;

(6) starting the standard golf club at a 9:00 position of said yellow-colored segment and drawing body back in a backswing as far possible without undue strain, curling back arms, wrists, shoulders, and hips in a smooth manner while shifting body weight to user's right leg until reaching a full-coiled position, while keeping elbows close to user's body and maintaining left arm in a straight alignment, repeating step (6) until developing a comfortable mastery of step (6), and then practicing step (4), step (5), and step (6) in combination as a single drill;

(7) engaging the standard golf club against said yellow-colored segment, unwinding body and arms by reverse-pivoting user's hips, shoulders, and then arms, while shifting body weight from right foot to left foot until user's wrist reaches 9:00 of said red-colored segment, and repeating step (7) until developing a comfortable mastery of step (7);

(8) placing hands at a 9:00 position of said red-colored segment while the standard golf club intersects said guide ring at 11:00, and while equalizing body weight to both legs, swinging the standard golf club quickly downward whereupon body weight is simultaneously shifted quickly to user's left foot and user's wrists are gradually straightened until the standard golf club intersects said red-colored segment at 6:00, and repeating step (8) until developing a comfortable mastery of step (8), and then practicing step (8) and step (7) in combination as a single drill;

(9) lifting user's right heel immediately after making contact with the golf ball so as to allow user's body to twist through swing, maintaining user's head in a downward position while peering over right shoulder, and maintaining both arms in a straight position until arms reach 3:00 of said black-colored segment as user swings through impact, maintaining a substantial majority of body weight on user's left leg during completion of impact swing, repeating step (9) until developing a comfortable mastery of step (9), and then practicing step (9), step (8), and step (7) in combination as a single drill; and

(10) starting the standard golf club at 3:00 of said orange-colored segment, relaxing wrists and arms and coling upper torso over user's left shoulder while twisting body leftward to absorb energy of swing, positioning user's back in a relatively upright position and pointing upper torso toward a target, and positioning the standard golf club over user's left shoulder, repeating step (10) until developing a comfortable mastery of step (10), and then practicing step (10) and step (9) in combination as a single drill.

* * * * *